United States Patent [19]

Williams et al.

[11] Patent Number: 4,851,794

[45] Date of Patent: Jul. 25, 1989

[54] MICROSTRIP TO COPLANAR WAVEGUIDE TRANSITIONAL DEVICE

[75] Inventors: Dylan F. Williams; Tommy H. Miers, both of Boulder, Colo.

[73] Assignee: Ball Corporation, Muncie, Ind.

[21] Appl. No.: 106,211

[22] Filed: Oct. 9, 1987

[51] Int. Cl.[4] ..... H01P 5/08

[52] U.S. Cl. ..... 333/33; 333/247; 324/158 P

[58] Field of Search ..... 333/26, 33, 246, 247, 333/260; 324/158 P

[56] References Cited

U.S. PATENT DOCUMENTS

| | | | |
|---|---|---|---|
| 3,990,024 | 11/1976 | Hou | 333/33 |
| 4,135,170 | 1/1979 | Baril et al. | 333/246 X |
| 4,211,987 | 7/1980 | Pan | 333/246 X |
| 4,494,083 | 1/1985 | Josefsson et al. | 333/33 |
| 4,593,243 | 1/1985 | Lao et al. | 333/33 X |
| 4,636,753 | 1/1987 | Geller et al. | 333/26 |
| 4,697,143 | 9/1987 | Lockwood et al. | 333/246 X |
| 4,764,723 | 8/1988 | Strid | 333/246 X |

FOREIGN PATENT DOCUMENTS

| | | | |
|---|---|---|---|
| 2449977 | 10/1980 | France | 333/33 |
| 2462787 | 3/1981 | France | 333/33 |
| 86/06495 | 11/1986 | PCT Int'l Appl. | 333/246 |
| 856889 | 12/1960 | United Kingdom | 333/238 |

*Primary Examiner*—Eugene R. LaRoche
*Assistant Examiner*—Benny Lee
*Attorney, Agent, or Firm*—Gilbert E. Alberding

[57] ABSTRACT

A novel transition device is disclosed capable of being used in an integrated circuit comprising a substrate having a first planar surface upon which at least one circuit element is formed and a second planar surface upon which a ground metallization is formed, said first planar surface being spaced from and parallel to the second planar surface, said at least one circuit element being connected to a metal strip and having an open end terminating on said first planar surface, a coplanar grounding station disposed on the first planar surface and situated adjacent to and spaced from said open end, said coplanar grounding station being free of any electrically conducting path between said metal strip and said coplanar grounding station and between said ground metallization and said copolanar grounding station.

The expression grounding station as used herein may be defined as a planar structure comprising of at least one metallized patch situated to and spaced from a strip transmission line, said patch lying parallel to and separated from a ground plane of said line, said patch not being electrically connected to said transmission line.

33 Claims, 2 Drawing Sheets

MICROSTRIP TO COPLANAR WAVEGUIDE TRANSITIONAL DEVICE

BACKGROUND OF THE INVENTION

This invention relates to transitional means between different transmission lines and for the fabrication thereof. More particularly, the subject invention relates to a novel transitional device for certain interconnections associated with planar circuits, the device being especially adapted for making measurements in probing a circuit under testing condition without resorting to conventional transitional techniques.

Integrated circuits usually consist of a large number of active circuit electronic components that generate or amplify electromagnetic energy in combination with passive components that detect or control such energy upon a semiconductor substrate. Integrated circuits are often fabricated by a number of process steps including film formation, impurity doping, lithography and etching which, in turn, call for special techniques, including vacuum and vapor-phase deposition, including molecular beam epitaxy, solid-state diffusion, implantation, and sputtering.

Planar structures or electrical circuits are well-known to the art, particularly in the field of integrated circuit technology, and more particularly, in the field of microwave technology. As regards such planar electrical circuits, distributed components are generally dispersed along an entire length or area of the circuit instead of being concentrated or lumped in confined areas. More importantly, distributed components are generally constructed of a metallized strip of a certain configuration with a ground plane separated by a solid dielectric and are commonly referred to as microstrip, coplanar and slotline structures. The metallized strip is a flat strip-type conductor on a dielectric substrate and is disposed close to an r. f. ground in such a way as to provide particular r. f. impedance for the circuit.

Integrated circuits are devices with the various active and passive components arranged in an array or pattern upon a planar substrate. It is the planar configuration with the closely packed circuit components that are simultaneously fabricated directly thereon that make such devices so practical. Indeed, the planar structure is responsible for the ease of fabrication and the economic importance of integrated circuits, the substrate thereof being any one of several materials including alumina, Teflon laminated board as well as semiconductor crystalline materials.

There are several types of integrated circuits that are used commercially. One common type is the so-called monolithic microwave integrated circuit (MMIC). Briefly, a monolithic integrated circuit has all of the circuit components and elements formed in situ on the semiconductor substrate. In a monolithic integrated circuit, there are no components that stand in substantial relief on the planar substrate as found, say, in a hybrid integrated circuit, as the entire integrated circuit of the monolithic structure is formed in or on the substrate. Again, it is this flat or planar structure that allows batch processing and mass fabrication of reliable circuits.

Because of more and more circuit miniaturization, circuits have become exceedingly small in size with the various active and passive components being closely packet thereon. It can, therefore, be appreciated that such miniature circuits present special problems in attempts at testing, tuning or troubleshooting. In the fabrication of integrated circuits, a producer must depend upon computer-aided design techniques to achieve uniform quality of such integrated circuits. It is only recently that probing equipment has become commercially available for testing miniature circuits whereby reliable and accurate measurements can be made on an ongoing basis. Such measurements are necessary and desirable, especially before dicing or cutting a large array of the wafer structure to form the individual integrated circuits.

Conventional probe cards have been employed for making radio frequency measurements, especially at low frequencies for silicon integrated circuits. When probing is done on the whole wafer, this is known as on-wafer circuit testing. Probe cards are capable of operating at frequencies up to above 4 GHz and generally use needle-like probes. However, because of inductance of the individual probes and the associated inter-probe capacitances, such probe structures at higher frequencies present serious difficulties in making reliable measurements, particularly at frequencies much above 10 MHz.

Test probe heads have been used to perform r. f. measurements and are constructed and designed to provide low loss, closely matched (low imput voltage standing wave ratio) signal path from the measurement equipment to the r. f. input and output connecting points of the component being investigated on an integrated circuit. By the use of the testing probes heads, circuity of an electrical component or device can be readily evaluated during its early stages of modeling and, of course, during production, and any defective circuits readily identified.

In probing machines currently in use, a wafer or other electronic device to be tested is properly aligned and the tip contacts or electrodes of the probes are guided to selected pads (usually round or square shaped indicia or about two to five mils in size) on the device under test and make interface engagement of the tip contacts with the electrodes. Upon making interface contact, the probing equipment evaluates the electrical operation of the device under test.

Coplanar wave guide (CPW) probes have been utilized to make measurements at very high frequencies. Such CPW probing devices have been found to be operative at high frequencies in the complex and closely packed geometrical environment where many thousand of components are patterned on a substrate.

In making measurements on a planar structure such as an integrated circuit, the signal and ground electrodes of a probe must make contact and be in alignment with precise points on the component under test. Using a probe that employs a coplanar waveguide for contacting corresponding points on a planar structure is not a easy undertaking. In this regard, it should be appreciated that the probe contact is generally to an active device through a microstrip transmission line, a highly utilized metallization of integrated circuits.

SUMMARY OF THE INVENTION

In a microstrip as used in integrated circuits and the like, it is necessary that some means of achieving a low inductance ground be available on the topside under test in order to make measurements. Since a microstrip does not have any topside ground plane, it is common practice to use either a wraparound or a via hole in order to present on one, single surface means to make concurrent contact with the electrode tips of the probing equipment.

As can be appreciated, a wraparound ground requires metallization near the periphery of the circuit so that the metallization can be fully brought around to the other side. It can be recognized that this particular forming step would present difficulties in fabrication and, therefore, this particular technique is not generally favored.

The most common and conventional approach has been simply to use via holes that permit grounds positioned directly through the substrate as required by a particular planar structure. In practice, via holes are made by either chemically etching the substrate, plasma etching or other milling means. In general, plasma etching forms a more symmetrical opening whereas chemical milling produces a conical opening. It follows that special consideration must be made in dealing with the latter type of opening since its inductance must be calculated. Nonetheless, in etching with either method, the process is carried out until the patterned metallization with the active and passive devices is reached and the openings thereby formed are thereafter filled or metallized when the ground plane is formed or disposed on the planar structure. Generally, each opening through the substrate is of a predetermined diameter, usually between about 4 to 6 mils.

As can be appreciated, conventional coplanar waveguide probes are made to engage the gound plane metallization on the topside of a planar structure. Since microstrip circuits require a ground plane metallization on the bottomside surface, via holes or wraparound structures have, heretofore, been conventionally employed. It is obvious that such methods of introducing a grounding structure on the topside of a substrate or planar structure is time consuming, involving special handling and processing steps that are performed on usually delicate materials. It is needless to say that all these factors result in higher production costs and the likehood of fabrication failures.

It is an object of this invention to provide a transition between a microstrip and coplanar waveguide probe that does not require a wrap or via hole electrical conductive connection.

It is a further object of this invention to provide a wideband electrical ground on one surface of a substrate in conjunction with signal or input port on the same surface, the wideband electrical ground being formed without resorting to a conductive metal pathway.

It is still another object of this invention to provide a novel transition between a microstrip and a coplanar waveguide probe suitable for measurement of functionality for at least one electrical component including amplifiers, bipolar transistors, field effect transistors, diodes, directional couplers, phase shifters, circulators, isolators, attenuators, detectors, quadrature hybrids, mixers and the like.

It is yet another object of this invention to provide a novel transitional device suitable for measuring on-wafer electrical characteristics including scattering parameters of at least one electrical component or many components as found on a planar substrate such as a wafer before the wafer is divided to produce individual integrated circuits or chips.

It is still another object of this invention to achieve a low inductance ground on the topside of an integrated circuit in the absence of via holes or wraparound grounds.

It is still a further object of this invention to provide low inductance ground stations on the topside metallization of a substrate having at least one circuit without forming electrically conductive pathways by etching or milling channels through said substrate with subsequent filling or metallization thereof.

We have discovered a novel transitional device for establishing a transition between a microstrip and coplanar arrangement for integrated circuits without milling channels and fabricating via holes or wraparound structures as has heretofore been employed in the art.

In one aspect, our transitional device features a grounding station means spaced from and adjacent to a microstrip line, said grounding station being free of metallic conductors paths between said microstrip and station. In a preferred embodiment, the grounding station is a radial patch or stub situated adjacent to and spaced from an open termimal end of a metal strip, said station being situated over a ground plane.

From another aspect, the subject invention relates to a transitional device for establishing a transition between a microstrip and a coplanar arrangement including a signal electrode and at least one ground electrode, said microstrip having a bottom conductive plane and an upper conductive strip terminating in an open port, said device comprising grounding station means formed adjacent to and spaced from said open port to define a patch of low impedance, said patch being free of any electrically conducing path between said open port and said conductive plane and said open port and said station.

From yet another aspect, the instant invention provides an integrated circuit comprising a semiconductor having a first planar surface upon which is formed at least one circuit element and second planar surface upon which is formed a ground metallization, said first planar surface being spaced from and lying parallel to said second planar surface, a metal strip connected to said at least one circuit element and having an open end disposed in said first planar surface, a coplanar grounding station formed on said first planar surface adjacent the open end of said metal strip and spaced therefrom to define a radial stub, said radial stub having two spaced apart ground points and being free of any metallic conductor or electrically conducting means for electrically connecting said metal strip to said radial stub and for electrically connecting said ground metallization to said radial stub, said radial stub being arranged and positioned so that a contact point on the open end of said metal strip extends between said two spaced apart ground points, said ground points being equally spaced from the contact point on said radial stub and said contact points and said ground points are all collinear.

It should be emphasized that radial stubs have been utilized in strip-line circuits and the like, generally as shunt elements in conjunction with low-pass filters to achieve certain characteristic impedances over substantial frequency ranges. However, such radial line stubs are electrically connected to and integral with the strip line and provide a well-defined contact point therewith.

In testing or investigating an electrical component, the subject invention can be readily used with a single or two-terminal (two-port) pair. In such a situation, the transition from a microstrip is to coplanar strips, the inverse structure to the coplanar waveguide. In making a reflection coefficient determination, for example, a single terminal of a device under test in conjunction with the subject invention would be all that would be needed with conventional testing or probing equipment. In the case of measuring the reflection coefficient, for example, where valves between 0 and 1.0 are obtained and indicate the percentage of energy reflected, a single two-port pair of a microstrip line would be all that would be needed in accordance with the subject invention. Again, in making electrical measurements, say on an oscillator, a single pair would be all that would be needed in accordance with the subject invention. Moreover, two-terminal (or two-port) pair devices can also be readily used with the transitional device herein disclosed. In the case of microwave components, S-parameters, transmission and reflecting coefficients, can be easily made in accordance with the subject invention. In such a situation, the transition from a microstrip is to a coplanar waveguide, the inverse structure to the coplanar strips.

The expression grounding station as used herein may be defined as a planar structure comprising of at least one metallized patch situated to and spaced from a strip transmission line, said patch lying parallel to and separated from a ground plane of said line, said patch not being electrically connected to said transmission line.

BRIEF DESCRIPTION OF THE DRAWINGS

The above and other features of our invention will now be described in detail with reference to the accompanying drawings in which:

FIG. 2 is a perspective view of a prior art coplanar waveguide used as a probing device and the like;

DETAILED DESCRIPTION OF THE INVENTION

Broadly, the transitional device of our invention ensures substantially reasonable coupling between two kinds of transmission lines, the overall novel arrangement being durable, reliable, and easily employed, and more importantly, the subject novel arrangement reduces substantially the time and cost of making grounding features such as of conventional via holes or wraparounds.

Figure 1:
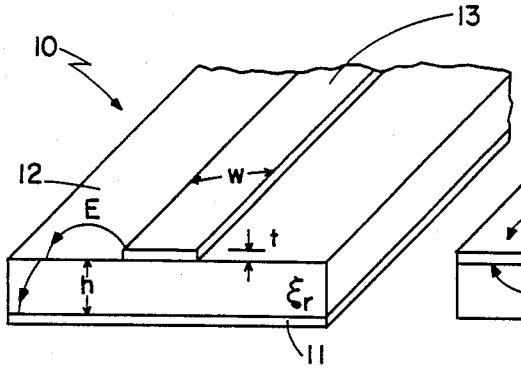
Fig. 1 Prior Art
FIG. 1 is a perspective view of a prior art microstrip structure showing the ground plane.

A typical microstrip structure is shown in a perpective view in FIG. 1. The microstrip structure 10 is provided with a ground metallization 11, a dielectric material 12 having a relative dielectric constant, $\epsilon_r$, and thickness, h, and a metal strip 13 having a width, w, and thickness, t. It is to be noted that the microstrip structure 10 has an open configuration to define an air-substrate interface which makes it convenient for use in microwave integrated circuits.

Figure 2:
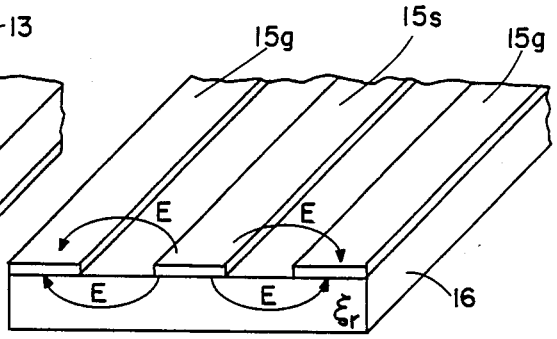
Fig. 2 Prior Art

A typical coplanar waveguide is shown in FIG. 2 in which three metal strips 15 are placed in parallel and are generally equally spaced apart from one another, the strips 15 being deposited on the topside surface of a dielectric material 16. It should be further observed that in the coplanar wavequide shown in FIG. 2, there are depicted a central signal carrying strip 15*s* and two symmetrically spaced ground strips 15*g*. Both FIG. 1 and FIG. 2 depict the E-field electrical vector.

Figure 3:
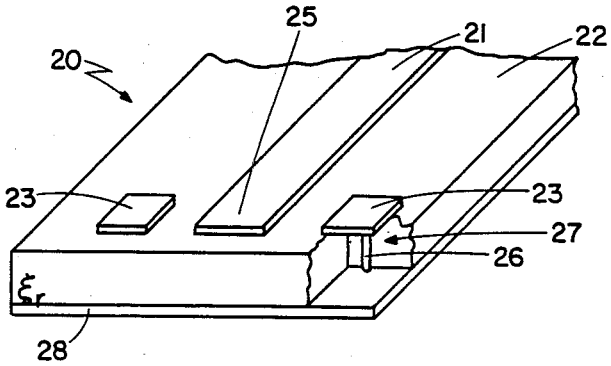
Fig. 3 Prior Art
FIG. 3 is a cutaway in perspective of a prior art device of a microstrip structure with ground pads and via holes.

A conventional microstrip with topside grounds is shown in FIG. 3 in which the microstrip structure 20 comprises a metal strip 21 formed on a dielectric substrate 22 on the topside thereof along with two evenly spaced pads 23 positioned adjacent to and spaced from the open end 25 of the metal strip 21. Attention is drawn to the cutaway portion which shows that the pads 23 are electrically connected by means of a metal conductive portion 26 to define via hole connections 27 between the pads 23 and a ground plane metallization 28. In such a microstrip structure, the metal strip 21 is a conductor formed or deposited by electrodeposition on the substrate 22 and is disposed close to the r. f. ground by metallization 28 whereby r. f. impedance is provided for the circuit.

Figure 4:
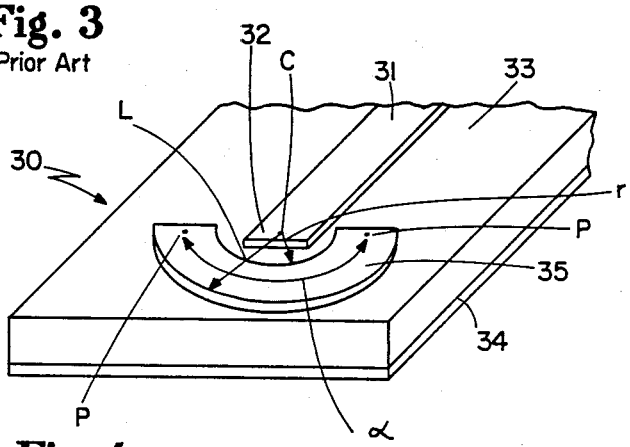
FIG. 4 is an embodiment in accordance with the subject invention.

A preferred embodiment of the subject invention is shown in FIG. 4. A transitional device 30 includes an metal strip 31 deposited on the topside of a dielectric substrate 33 and metallization 34 deposited on the bottom surface of the substrate 33. It is to be noted that the metallization 34 covers the whole area which is critical if a given circuit is to work properly, particularly in the microwave range. Further, it is to be noted that the metal strip 31 terminates in an open end 32 and is situated over the metallization 34. A coplanar grounding station 35 is disposed on the topside of the substrate 33 and is situated adjacent to an spaced from the open end 32 of the strip 31. In this embodiment, the grounding station 35 takes the shape of a radial patch and is spaced from the open end 32 or strip 31, said station 35 being symmetrically disposed therefrom. In accordance with this invention, station 35 is free of any metallic conducting path between the terminal portion of open end 32 of strip 31 and between metallization 34 and the station 35. In the embodiment of FIG. 4, the radial patch is evenly spaced from a center point C at the open end 32 and is so arranged that points P on station 35 are equally spaced from point C and fall on a circle having its center at point C. It is to be noted in this embodiment also that points C and P are collinear.

The transitional device of the subject invention utilizes a microstrip radial patch to provide a low impedance between the probe ground electrodes and the microstrip ground plane. This impedance can be estimated and is a function of the patch or stub length (L), the patch angle, $\alpha$, the substrate relative dielectric constant, $\epsilon_r$, the substrate thickness, h, and the inner radius of the patch or stub $r_r$. A large patch angle, $\alpha$, and a small patch inner radius, $r_1$, result in a lower patch impedance by changing the patch length (L)

$$L \cong \frac{\lambda_o}{2\pi\sqrt{\epsilon_r}}$$

where $\lambda_o$ is free space wavelength and $\epsilon_r$ is the relative dielectric constant of the substrate. The impedance of the patch is linearly related to the substrate thickness and inversely related to the patch or stub angle, $\alpha$. The bandwidth of the patch, defined as the frequency range for which the impedance of the radial stub is below some threshold impedance, increases as the path angle, $\alpha$, increases and the substrate thickness decreases. For any given frequency of operation, the optimum stub has a length given approximately by $$L \cong \frac{\lambda_o}{2\pi\sqrt{\epsilon_r}},$$

a small substrate thickness and a large stub angle $\alpha$. When the length of the stub is close to that given by $$L \cong \frac{\lambda_o}{2\pi\sqrt{\epsilon_r}}$$

and the stub angle is large, the stub impedance is also least sensitive to the substrate thickness, which is often difficult to control in practice. It will be appreciated that this is an important advantage when making measurements on substrates with differing thicknesses. The patch or stub structure may take on different geometrical shapes and, therefore, be bound by straight and/or curved surfaces. If the structure is a single radial patch, a slot is provided to the central portion of the patch to acommodate a transmission line therein, the slot being generally rectangular is shape. The path or stub angle, $\alpha$, may vary over a wide range as circumstances dictate and may in general range from about 10° to about 285°.The lower angular configuration being more or less limited by the bandwidth and the larger angular configuration being limited by the geometry, spacing and coupling with other adjacent components and the like.

When the frequency of operation rises to the point when the patch length approaches approximately a half wavelength in the dielectric, the stub impedance becomes very large. Thus, the point at which the patch or stub length (L) is given by $$L \cong \frac{\lambda_o}{2\pi\sqrt{\epsilon_r}} 3.832$$

represents approximately the maximum frequency of the stub operation.

As can be appreciated by those skilled in the art, the number 3.832 is the first root of the Bessel function of the first kind of order one. At this L value, the electrical impedance between the points 68 and the group plane of FIG. 4*a* becomes substantially larger.

Figure 5:
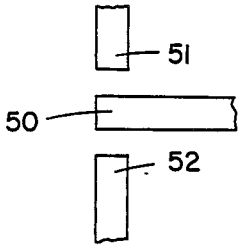
FIG. 5 is another embodiment in accordance with the subject invention.
Figure 6:
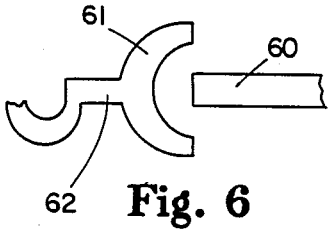
FIG. 6 is yet another embodiment of the subject invention.
Figure 7:
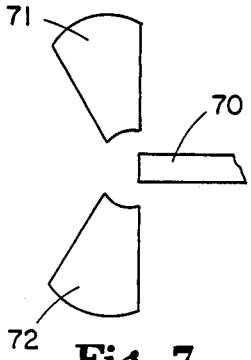
FIG. 7 is still yet another embodiment of the subject invention.

The grounding station or transitional device of the subject invention in the preferred embodiment is an integral radial stub structure, but it will be appreciated that the station need not be a one-piece or integral structure. FIG. 5, 6 and 7 show embodiments in which the grounding station comprises two associated stub structures. In FIG. 5, two one-quarter wavelenght strips, 51 and 52, are disposed adjacent to a strip 50 of microstrip transmission line. FIG. 7 depicts another alternative embodiment in which two stubs, 71 and 72, are disposed ($\theta$=20°) adjacent a strip 70 of microstrip transmission line. FIG. 6 depicts a radial stub 61 associated with a microstrip transmission line 60, the stub 61 having one-quarter wavelength extension 62.

Figure 4A:
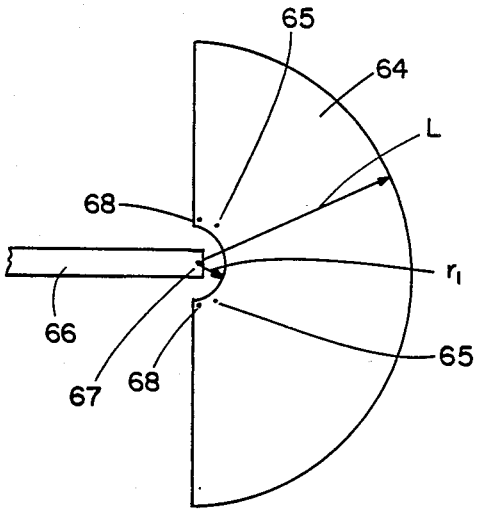
FIG. 4*a* is a particular embodiments of the subject invention showing a top view of a radial patch.

FIG. 4*a* depicts another preferred embodiment, wherein a radial stub 64 is provided with ground points 68 situated on opposing sides of an open end 67 of a microstrip transmission line 66. In general, a radial stub 64 when formed in a substrate such as gallium arsenide, the radius $r_1$ could have a range of about $$\frac{\lambda_o}{6\pi\sqrt{\epsilon_r}} < L < \frac{\lambda_o}{2\pi\sqrt{\epsilon_r}} 3.832$$

Also, as in the substrate tickness, t, the following is generally preferred:

$$t < \frac{\lambda_o}{10\pi\sqrt{\epsilon_r}},$$

Figure 2A:
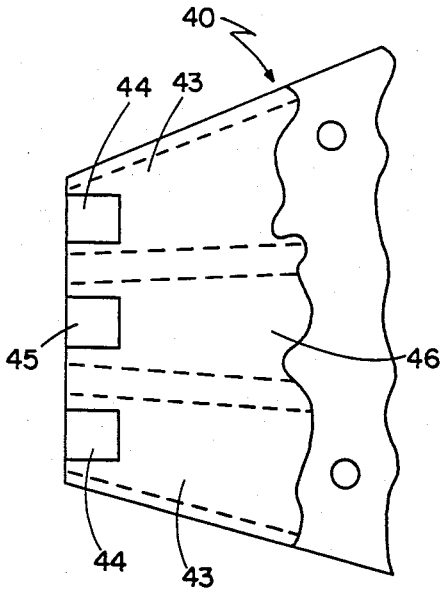
FIG. 2*a* depicts a top view of a probing head showing the signal and ground electrodes.

The geometric of a typical coplanar probe head 40 is shown in FIG. 2*a*. The probe consists of a coplanar wavequide transmission line with signal line 46 and ground lines 43 printed on the bottom of the probe arm 42, and with three raised electrodes or pads 44 and 45 at the probe tip which contact the terminals to be tested on the surface of a planar substrate. The two outer electrodes 44 contact ground connections, and the signal line is contacted by the center electrodes 45.

Coplanar probe devices provide an efficient, accurate means of performing S-parameter measurements on monolithic microwave ingrated circuits to at least 50 GHz and often times even higher. In general, S-parameters (scattering parameters) may be used to define a two-port network. S-parameters use reflected and transmitted signal voltages at both the input and the output of a two-port network.

As mentioned, a coplanar probe is ideally suited for making S-parameter measurements of planar devices. The outer coplanar probe electrodes contact the device ground while the center electrode contacts the signal lines for the input and output of the planar device. The use of coplanar waveguide probes in performing S-parameter measurements in microstrip, with microstrip state-of-the-art probing technique, in not as straightforward since as previously disclosed, the ground plane of a microstrip transmission line is on the bottom surface of the substrate where it is not easily contacted by the outer ground electrodes of the coplanar probe. The present transitional device circumvents these difficulties.

The grounding station herein disclosed may be readily be electrodeposited, formed, or connected by other means to a structure such as a wafer or the like for circuit testing and prior to division into individual integrated chips. Further, if it is desirable, the grounding station may be removed by cutting such devices or etching them off from the wafer when a particular network or circuit is satisfactory and all the necessary tests have been carried out.

Figure 10:
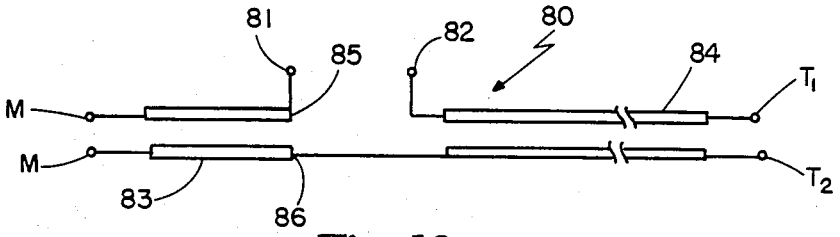
FIG. 10 is an equivalent circuit diagram of the subject invention.

FIG. 10 depicts an electrical equivalent circuit 80 in which 81 is the coplanar probe ground contact, 82 represents the coplanar signal probe contact, 83 the radial stub, and 84 the microstrip transmission line. It should be noted that there is an open circuit between points M. The device to be tested may be readily mounted to $T_1$ and $T_2$. When a radial stub is approximately a quarter of a wavelength long, the electrical impedance between points 85 and 86 is very low, resulting in a very good transition. When a radial stub is used in accordance with the subject invention, the effective dielectric constant does not vary significantly with frequency, and the electrical impedance between points 85 and 86 is independent of substrate thickness. It can be appreciated that substrate thickness may be difficult to a accurately control.

Figure 8:
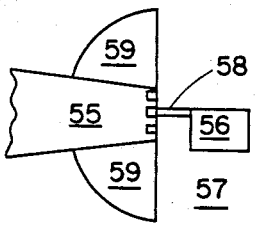
FIG. 8 is a magnified view of a component of an integrated circuit with a probing head means associate therewith.
Figure 9:
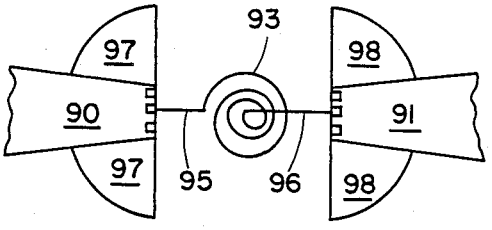
FIG. 9 is a magnified view of another component of an integrated circuit with a pair of probing heads associated therewith.

The transitional device of the subject invention may be used, as previously disclosed, for one-port or two-port, probing measurements. FIG. 8 depicts a single head 55 associated with a device 56 on a substrate 57, the device 56 having a microstrip transmision line 58 with an associated radial stub 59. FIG. 9 shows two probe heads 90 and 91 positioned on opposite sides of an electrical component 93, such as spiral inductor embedded microstrip. The transitional device of the subject invention is shown comprising inlet and outled transmission line 95 and 96 with radial stubs 97 and 98, respectively.

The transition of the subject invention has been found to operate satisfactory up to 26.5 GHz. The stub length was 1375 mm and the stub angle, $\alpha$, or 180 degrees. The transitions were fabricated on a semi-insulating gallium arsenide substrate having a thickness of about 92 $\mu$m and relative dielectric constant of about 12.9. The transitions were patterned by lifting off a 1.7 $\mu$m thick layer of evaporated gold with a 500 angstrom thick titanium adhesion layer. The optimum frequency of operation was 10.6 GHz and the maximum frequency of operation was approximately 40 GHz. It has been determined that the transitional divice has less than $-0.15$ dB insertion loss and greater than $-20$ dB return loss between 5 GHz and 25 GHz. As an aid of location of probe head tips, it is most advantageous to have means for controlling tip placement. Alignment keys 65 (FIG. 4*a*) in the form of small holes were printed on the radial stub to aid in controlling the probe placement.

A wide range of substrates may be used in conjunction with the subject invention and include alumina, Teflon (PTFE), sapphire and quartz, silicon, silicon on sapphire, germanium, gallium arsenide, gallium antimonide, indium arsenide, indium antimonide and indium phosphide, as well as other Group III–Group V and Group II–Group VI compound semiconductor and microwave 14 millimeter wave substrates.

Although there has been described a preferred embodiment of this novel invention, many variations and modifications will now be apparent to those skilled in the art. Therefore, this invention in to be limited, not by the specific disclosure herein, but only by the appending claims.

We claim:

1. A method for use in conjunction with assessing performance of one or more elements in an electrical circuit, said one or more elements being disposed on a substantially planar top surface of a substrate and being electrically connected to a metal strip disposed on said top surface, and said substrate having a substantially planar bottom surface which is substantially parallel to said top surface and upon which a ground metallization is provided, comprising:

providing at least one metallized patch on said top surface, said at least one metallized patch being free from direct electrical connection with said ground metallization;

passing and electrical signal through said one or more elements and said metal strip;

contacting said metal strip with at least one signal electrode of a performance assessment means;

contacting said at least one metalized path with at least one ground electrode of said performance assessment means;

creating a region of low impedance in said substrate adjacent to said metal strip and said at least one metallized patch;

utilizing said region of low impedance to establish a reference for said performance assessment means; and, assessing the performance of said one or more elements.

2. A method as recited in claim 1, further comprising the step of aligning said at least one ground electrode of siad performance assessment means relative to one or more preselected locations on said at least one metallized patch

3. A transitional device capable of making a transition between a microstrip and a coplanar arrangement including a signal electrode and at least one ground electrode, said microstrip having a bottom conductive plane and an upper conductive strip terminating in a open port, said device comprising a grounding station formed adjacent to and spaced from said open port to define a patch of low impedance, said station being free of any electrically conducting path between said port and said patch and between said conductive plane and said station, wherein the path has a substantially radial pattern relative to said open port, and wherein during use of said device said signal electrode contacts said upper conductive strip and said ground electrode contacts said station.

4. A transitional device as recited in claim 3 wherein the patch has a path angle relative to said open port of about 285° or less.

5. A transitional device as recited in claim 3 wherein the radial patch has a length (L) measured from said open port to substantially the outer periphery of the radial patch approximated by the following equation:

$$L = \frac{\lambda^{\circ}}{2\pi\sqrt{\epsilon\gamma}}$$

Where $\lambda_o$ is the free space wavelength and $\epsilon_\gamma$ is the relative dielectric constant of material between the bottom conductive ground plane and the upper conductive strip.

6. A transitional device as recited in claim 5 wherein the material is selected from the group consisting of alumina, silicon, silicon on sapphire, germaninum, gallium arsenide, Group III–Group V compounds and Group II–Group VI compounds.

7. A transitional device as recited in claim 3 wherein the radial patch is provided with alignment means for use in aligning said at least one ground electrode of said coplanar arrangement relative to said radial patch.

8. A transitional device as recited in claim 3 wherein said coplanar arrangement includes at least two ground electrodes, said two ground electrodes being symmetrically arranged about said signal electrode and being releasably electrically connected to said grounding station, and said signal electrode being releasably electrically connected to said open port of said conductive strip.

9. A transitional device as recited in claim 3 wherein the radial patch has a length (L) measured from said open port to substantially the outer periphery of the radial patch for a given frequency between about:

$$\frac{\lambda^{\circ}}{6\pi\sqrt{\epsilon\gamma}} \text{ and } \frac{\lambda^{\circ}}{2\pi\sqrt{\epsilon\gamma}} 3.832$$

where $\lambda_o$ is the free space wavelength and $\epsilon_\gamma$ is the relative dielectric constant of the material between the bottom conductive ground plane and the upper conductive strip.

10. A transitional device capable of being used to make a transition between an assembly having a signal electrode and at least one ground electrode and an integrated circuit comprising a substrate having a first planar surface upon which at least one circuit element is formed and a second planar surface upon which a ground metallization is formed, said first planar surface being spaced from and parallel to the second planar surface, said at least one circuit element being connected to a metal strip and having and open end terminating on said first planar surface, said device comprising a coplanar ground station disposed on the first planar surface and situated adjacent to and spaced from said open end, said coplanar grounding station being free of any electrically conducting path between said metal strip and said coplanar grounding station and between said ground metallization and said coplanar grounding station, wherein said grounding station has a substantially radial pattern relative to said open end of said strip metal strip, and a wherein during use of said device said signal electrode contacts said metal strip and said at least one ground electrode contacts said station.

11. An integrated circuit as recited in claim 10 wherein the metal strip and ground metallization are formed on said substrate to define a medium for electromagnetic wave propagation therebetween.

12. An integrated circuit as recited in claim 10 wherein the metal strip and ground metallization formed on said substrate define a finite microstrip waveguide capable of supporting a TEM mode of propagation.

13. An integrated circuit as recited in claim 10 wherein the circuit comprises a plurality of active and passive circuit elements and interconnections deposited on said substrate to define a monolithic integrated circuit.

14. An integrated circuit comprising a substrate having a first planar surface upon which is deposited at least one circuit element and a second planar surface upon which is deposited a ground metallization, said first planar surface being spaced from and lying parallel to said second planar surface, a metal strip connected to said at least one circuit element and having an open end disposed on said first planar surface, a coplanar grouding station situated on said first planar surface adjacent to and in a substantially radial pattern about the open end of said metal strip to define a radial patch of low impedance said coplanar ground station being free of any electrically conducting path between said metal strip and said radial patch and between said ground metallization and said station, wherein an assembly having a signal electrode and a ground electrode may be operatively interconnected with said integrated circuit by contacting said signal electrode to said metal strip and contacting said ground electrode to said station.

15. An integrated circuit as recited in claim 14 wherein the radial patch has a length (L) measured from said open end of said metal strip to substantially the outer periphery of the radial patch approximate by the following equation:

$$L = \frac{\lambda^{\circ}}{2\pi\sqrt{\epsilon\gamma}}$$

where $\lambda_o$ is the free space wavelength and $\epsilon_\gamma$ is the relative dielectric constant of the substrate.

16. An integrated circuit as recited claim 14 wherein the radial patch has a length (L) measured from said open end of said metal strip to substantially the outer periphery of the radial patch for a given frequency between about:

where $\lambda_o$ is the free space wavelength and $\epsilon_\gamma$ is the relative dielectric constant of the subtrate therefor.

17. An integrated circuit as recited in claim 14 wherein the radial patch has a patch angle relative to said open end of said metal strip of about 285° or less.

18. An integrated circuit as recited in claim 14 wherein the radial patch is provided with alignment means for aligning at least one ground electrode of an interfacing device relative to said radial patch.

19. An integrated circuit comprising a substrate having a first planar surface upon which is formed at least one circuit element and a second planar surface upon which is formed a ground metallization, said first planar surface being spaced from and lying parallel to said second planar surface, a metal strip connected to said at least one circuit element and having an open end disposed on said first planar surface, a coplanar grounding station formed in said first planar surface adjacent the open end of said metal strip and spaced therefrom to define a stub haivng a radial pattern relative to said open end of said metal strip, said radial stub having two spaced apart contact points and being free of any electrically conducting means for electrically connecting said metal strip to said radial stub and for electrically connecting said ground metallization to said radial stub, said radial stub being arranged and positioned so that a contact point on the open end of said metal strip is located between said two spaced apart contact points of said stub, said contact points of said stub being equally spaced from and collinear with said contact point on said metal strip.

20. An integrated circuit as recited in claim 19 wherein the circuit comprises a plurality of active and passive circuit elements and interconnections deposited on said first planar surface of said substrate to define a monolithic microwave integrated circuit.

21. An integrated circuit as recited in claim 19 wherein the substrate comprises a material is selected from the group consisting of silicon, germanium, gallium arsenide, Group III–Group V compounds and Group II–Group VI compounds.

22. An integrated circuit as recited in claim 19 wherein the radial stub has length (L) measured from said open end of said metal strip to substantially the outer periphery of the radial stub of about one-quarter wavelength of the operating electrical frequency or some multiple thereof.

23. An integrated circuit as recited in claim 19 wherein the radial stub has a radial angle relative to said open end of said metal strip of about 285° or less.

24. An integrated circuit comprising a substrate having a first planar surface upon which is formed at least one circuit element and a second planar surface upon which is formed a ground metallization, said first planar surface being spaced from and lying parallel to said second planar surface, a metal strip connection to said at least one circuit element and having an open end disposed on said first planar surface, a coplanar grounding station situated on said first planar surface and situated adjacent to and spaced from the open end of said metal strip to define a stub having a substantially radial pattern relative to said open end, said radial stub being free of an electrically conducting path between said metal strip and said radial stub as well as between said ground metallization to said radial stub, and a probe tip means engagingly associated with said integrated circuit and having at least one signal pad and at least one ground pad, said at least one signal pad forming an electrically conducting path with the open end of said metal strip and said at least one ground pad forming an electrically conducting path with said radial stub.

25. An integrated circuit as recited in claim 24 wherein the substrate comprises a material selected from the group consisting of alumina, germanium, silicon, silicon on sapphire, gallium Group III–Group V compounds and Group II–Group VI compounds.

26. An integrated circuit as recited in claim 24 wherein the radial stub has a length (L) measured from said open end of said metal strip to substantially the outer periphery of the radial stub of about one-quarter wavelength of the operating electrical frequency or some multiple thereof.

27. An integrated circuit as recited in claim 24 wherein the circuit comprises a plurality of active and passive circuit elements and interconnections deposited on said first planar surface of said substrate to define a monolithic microwave integrated circuit.

28. An integrated circuit as recited in claim 24 wherein the probe tip means includes at least two ground pads, said ground pads and said signal pad all being positioned in a collinear arrangement.

29. An integrated circuit as recited in claim 24 wherein the probe tip means includes at least two ground pads, the signal pad being arranged symmetrically in the space between the two ground pads to define a coplanar waveguide.

30. An integrated circuit as recited in claim 24 whereon the coplanar grounding station is provided with alignment keys for aligning at least one of said ground pads relative to said radial stub.

31. A device for use in assessing performance of one or more elements in an electrical circuit, said one or more elements being mounted on a substantially planar top surface of a substrate and being electrically connected to metal strip which is mounted on said top surface and which has an open end, and said substrate having a substantially planar bottom surface which is substantially parrallel to said top surface and upon which a ground metallization is provided, comprising:

at least one metallized patch formed on said top surface;

said at least one metallized patch being free from electrical connection with said ground metallization; and, said at least one metallized patch being positioned relative to said ground metallization to define a region of low impedance substantially therebetween, and said at least one metallized patch being positioned adjacent to, spaced from and symmetrically about said open end of said metal strip; wherein a signal electrode of a means for assessing performance of said one or more elements may selectively contact said metal strip at substantially said open end thereof, and a ground electrode of said means for assessing performance may selectively contact said at least one metallized patch to permit assessment of the performance of said one or more elements; and wherein said metallizad patch is free from affecting the operation of said elements and said metal strip during normal use of said electrical circuit and during performance assessment of said one or more elements.

32. A device as recited in claim 31 above, wherein the distance from said open end of said metal strip to the outer periphery of said at least one metallized patch is substantially equal to one-quarter wavelength of the operating signal frequency of the electrical circuit or some multiple thereof.

33. A device as recited in claim 31 above, further comprising means for aligning said at least one ground electrode of said for assessing performance of said one

* * * * *